US007722525B2

(12) United States Patent
Andrews

(10) Patent No.: US 7,722,525 B2
(45) Date of Patent: May 25, 2010

(54) LATERAL COUPLING OF AN IMPLANTABLE HEARING AID ACTUATOR TO AN AUDITORY COMPONENT

(75) Inventor: Travis Rian Andrews, Loveland, CO (US)

(73) Assignee: Otologics, LLC, Boulder, CO (US)

( * ) Notice: Subject to any disclaimer, the term of this patent is extended or adjusted under 35 U.S.C. 154(b) by 539 days.

(21) Appl. No.: 11/753,512

(22) Filed: May 24, 2007

(65) Prior Publication Data

US 2008/0293998 A1 Nov. 27, 2008

(51) Int. Cl.
*H04R 25/00* (2006.01)

(52) U.S. Cl. ..... 600/25

(58) Field of Classification Search ..... 600/25; 181/126–137; 607/55–57; 381/312–331; *H04R 25/00, H04R 25/02, 25/04*

See application file for complete search history.

(56) References Cited

U.S. PATENT DOCUMENTS

| | | | |
|---|---|---|---|
| 3,196,462 | A | 7/1965 | Robinson |
| 3,931,648 | A | 1/1976 | Shea, Jr. |
| 4,287,616 | A | 9/1981 | Heimke et al. |
| 4,462,401 | A | 7/1984 | Burgio |
| 4,462,402 | A | 7/1984 | Burgio et al. |
| 4,487,210 | A | 12/1984 | Knudsen et al. |
| 4,498,461 | A | 2/1985 | Hakansson |
| 4,628,907 | A | 12/1986 | Epley |
| 4,655,776 | A | 4/1987 | Lesinski |
| 4,774,933 | A | 10/1988 | Hough et al. |
| 4,904,233 | A | 2/1990 | Hakansson et al. |
| 5,061,280 | A | 10/1991 | Prescott ..... 623/10 |
| 5,085,628 | A | 2/1992 | Engebretson et al. |
| 5,144,952 | A | 9/1992 | Franchet et al. |
| 5,220,918 | A | 6/1993 | Heide et al. |
| 5,370,689 | A | 12/1994 | Causse |
| 5,486,197 | A | 1/1996 | Le et al. |
| 5,527,342 | A | 6/1996 | Pietrzak et al. |
| 5,584,695 | A | 12/1996 | Lal Sachdeva et al. |
| 5,735,790 | A | 4/1998 | Hakansson et al. |
| 5,776,144 | A | 7/1998 | Leysieffer et al. |
| 5,788,711 | A | 8/1998 | Lehner et al. |
| 5,820,369 | A | 10/1998 | Kvarnstrom et al. |

(Continued)

FOREIGN PATENT DOCUMENTS

WO 03055311 A1 3/2003

(Continued)

*Primary Examiner*—Charles A Marmor, II
*Assistant Examiner*—Catherine E Burk
(74) *Attorney, Agent, or Firm*—Marsh Fischmann & Breyfogle LLP

(57) ABSTRACT

An apparatus and method is provided for lateral contact loading of an implantable transducer relative to an auditory component. The apparatus may include a contact tip for directly contacting a lateral aspect of an auditory component, and a vibratory actuator adapted for axial displacement in response to the operation of an interconnected implantable hearing aid transducer. At least a portion of the vibratory actuator may be deflectable, wherein the contact tip is laterally displaceable upon lateral deflection of the vibratory actuator to apply a lateral loading force to an auditory component. In operation, the contact tip may be positioned to apply the lateral loading force upon initial placement and then automatically moved to maintain contact with the auditory component by virtue of deflection of the vibratory actuator, (e.g., responsive) post-implantation auditory component movement.

14 Claims, 8 Drawing Sheets

U.S. PATENT DOCUMENTS

| | | | | |
|---|---|---|---|---|
| 5,833,626 | A | 11/1998 | Leysieffer | |
| 5,840,078 | A | 11/1998 | Yerys | |
| 5,904,483 | A | 5/1999 | Wade | |
| 5,906,635 | A | 5/1999 | Maniglia | |
| 5,935,170 | A | 8/1999 | Hakansson et al. | |
| 5,941,814 | A | 8/1999 | Lehner et al. | 600/25 |
| 5,951,601 | A | 9/1999 | Lesinski et al. | |
| 6,001,129 | A | 12/1999 | Bushek et al. | |
| 6,039,685 | A | 3/2000 | Bushek | |
| 6,077,215 | A | 6/2000 | Leysieffer | |
| 6,099,462 | A | 8/2000 | Wengen | 600/25 |
| 6,261,223 | B1 | 7/2001 | Brillhart et al. | |
| 6,277,148 | B1 | 8/2001 | Dormer | |
| 6,315,710 | B1 | 11/2001 | Bushek et al. | |
| 6,325,755 | B1 | 12/2001 | Brushek et al. | |
| 6,390,970 | B1 | 5/2002 | Muller | |
| 6,398,717 | B1 * | 6/2002 | Leysieffer et al. | 600/25 |
| 6,482,144 | B1 | 11/2002 | Muller | |
| 6,488,616 | B1 | 12/2002 | Bushek et al. | |
| 6,491,622 | B1 | 12/2002 | Kasic, II et al. | 600/25 |
| 6,537,199 | B1 | 3/2003 | Muller et al. | 600/25 |
| 6,540,661 | B1 | 4/2003 | Muller | |
| 6,547,715 | B1 | 4/2003 | Muller et al. | |
| 6,579,317 | B2 | 6/2003 | Kurz | 623/10 |
| 6,592,513 | B1 | 7/2003 | Kroll et al. | |
| 6,705,985 | B2 | 3/2004 | Easter et al. | |
| 7,166,069 | B2 | 1/2007 | Schneider et al. | 600/25 |
| 2005/0228213 | A1 | 10/2005 | Schneider et al. | |

FOREIGN PATENT DOCUMENTS

| | | | |
|---|---|---|---|
| WO | 2007055092 | A1 | 3/2007 |
| WO | 2007083078 | A1 | 4/2007 |

* cited by examiner

LATERAL COUPLING OF AN IMPLANTABLE HEARING AID ACTUATOR TO AN AUDITORY COMPONENT

FIELD OF THE INVENTION

The invention is related to the field of hearing aids, and in particular, to the contact interface between an implantable hearing aid transducer and a component of the auditory system.

BACKGROUND OF THE INVENTION

Implantable hearing aids entail the subcutaneous positioning of some or all of various hearing augmentation componentry on or within a patient's skull, typically at locations proximate the mastoid process. Implantable hearing aids may be generally divided into two classes, semi-implantable and fully implantable. In a semi-implantable hearing aid, components such as a microphone, signal processor, and transmitter may be externally located to receive, process, and inductively transmit a processed audio signal to implanted components such as a receiver and transducer. In a fully implantable hearing aid, typically all of the components, e.g., the microphone, signal processor, and transducer, are located subcutaneously. In either arrangement, a processed audio signal is provided to a transducer to stimulate a component of the auditory system.

By way of example, one type of implantable transducer includes an electromechanical transducer having a magnetic coil that drives a vibratory actuator. The actuator is positioned to mechanically stimulate the ossicles via physical contact. (See e.g., U.S. Pat. No. 5,702,342.) Generally, such a vibratory actuator is mechanically engaged (i.e., coupled) with the ossicles during mounting and positioning of the transducer within the patient. In one example, such coupling may occur via a small aperture formed in the incus bone that is sized to receive a tip of the electromechanical transducer. In such an arrangement, the transducer tip may expansively contact the sides of the aperture, may be adhered within the aperture or tissue growth (e.g., osteointegration) may couple the transducer tip to the bone. One disadvantage of methods requiring a hole in the ossicle to facilitate attachment is that a surgical laser must be employed to ablate the ossicle's surface. The laser ablation procedure is burdensome and time consuming. Also, the required equipment is expensive and not present in every surgical setting. In other arrangements, clamps and/or clips are utilized to couple the vibratory actuator to an ossicle. However, such approaches can entail difficult implant procedures and yield sub-optimum coupling.

As will be appreciated, coupling with the ossicles poses numerous challenges. For instance, during positioning of the transducer, it is often difficult for an audiologist or surgeon to determine the extent of the coupling, or in other words, how well the actuator is attached to the ossicles. Additionally, due to the size of the transducer relative to the ossicles, it is difficult to determine if loading exists between the ossicles and transducer. For example, precise control of the engagement between the actuator of the transducer and the ossicles is of critical importance as the axial can only be effectively communicated when an appropriate interface or load condition exists between the transducer and the ossicles. Overloading or biasing of the actuator can result in damage or degraded performance of the biological aspect (e.g., movement of the ossicles) as well as degraded performance of the mechanical aspect (e.g., movement of the vibratory member). Additionally, an underloaded condition, i.e., one in which the actuator is not fully connected to the ossicles, may result in reduced performance of the transducer. In addition, once coupled for an extended period, the maintenance and/or replacement with a next generation transducer may be difficult. That is, in many coupling arrangements it may be difficult to de-couple a vibratory actuator/transducer.

SUMMARY OF THE INVENTION

In view of the foregoing, a primary object of the present invention is to simplify and improve implantation procedures for implantable devices, such as hearing aid transducers. Another object of the present invention is to allow for relative movement (e.g., lateral movement) between a component of the auditory system and an electromechanical transducer to account for physical variations of the auditory component caused by, for example, pressure changes, swallowing, etc. Another object is to provide auditory engagement means that allows for easily disengaging an auditory component.

One or more of the above objectives and additional advantages may be realized utilizing a contact or 'force loading' interface between an implantable transducer and a component of the auditory system. In this regard, a contact tip disposed at a distal end of a vibratory actuator (e.g., interconnected to an implantable transducer) may be laterally pressed against an auditory component (e.g., the ossicles) to provide a lateral load on the component. Tissue attached to the auditory component (e.g., ligaments) may maintain the actuator in contact with the auditory component for both positive and negative vibratory actuator displacement (e.g., axial displacement during operation of the implantable transducer.) In this regard, it has been determined that it is not necessary to physically attach the contact tip to the ossicle bone utilizing, for example, a hole drilled into the bone or by using a clip or clamp arrangement that extends around the ossicle bone to mount the transducer tip to the bone. That is, the lateral "force loading" of the ossicle bone provides the necessary contact for stimulation purposes.

In order to maintain the lateral force loading between the implantable transducer and an auditory component after an implant procedure it has been further recognized by the present inventors that it may be desirable to limit lateral movement of the auditory component relative to the vibratory actuator and/or to automatically reposition the vibratory actuator relative to the auditory component in conjunction with such lateral movement. In this regard, and by way of example, an ossicle bone may move laterally (e.g., in a direction transverse to a vibratory direction of the actuator) after an implant procedure as a result of pressure changes (e.g., changes in altitude) and/or physical movements of the patient (e.g., yawning). For purposes hereof, any such movement may be referred to as post-implantation auditory component movement.

In one aspect, an apparatus is provided that is employable with an implantable hearing aid transducer for mechanically stimulating an auditory component, wherein the apparatus comprises a vibratory actuator that is adapted for axial displacement in response to operation of an interconnected implantable hearing aid transducer, and a contact tip for directly contacting a lateral aspect of an auditory component, said contact tip being interconnected to a distal end of the vibratory actuator for axial displacement therewith. Of note, at least a portion of the vibratory actuator may be laterally deflectable, wherein the contact tip may be laterally displaceable upon lateral deflection of the vibratory actuator to apply a lateral loading force to an auditory component. In turn, enhanced contact maintenance between the contact tip and an auditory component may be realized.

Further this regard, the vibratory actuator may be laterally deflectable to laterally displace the contact tip in a first direction and/or a second direction (e.g., opposite to the first direction) within a predetermined displacement range (i.e., in either direction) that is greater than a predetermined maximum for post-implantation auditory component movement, thereby facilitating the maintenance of lateral loading contact post-implantation. In particular, a vibratory actuator may be provided which, in a deflected state, yields a predetermined displacement range with a maximum value of about 1 millimeters (i.e., lateral displacement of the contact tip) in either direction relative to an undeflected state.

Relatedly, the vibratory actuator may be provided so that the contact tip applies a lateral loading force within a predetermined force range when the contact tip is displaced at any position across a predetermined displacement range. In one embodiment, such predetermined displacement range may be 0.1 millimeters to 1 millimeters, with a corresponding predetermined force range of about 0.056 gf (grams of force) to 2.08 gf. In another embodiment, the predetermined displacement of range may be 0.3 millimeters to 1 millimeters, with a corresponding predetermined force range of about 0.168 gf to 2.08 gf.

Further, the vibratory actuator and interconnected transducer may be provided so that the lateral loading force applied by the contact tip to an auditory component is maintained at a magnitude which is greater than the magnitude of an axial load force applied by the contact tip to the auditory component. That is, the vibratory actuator and implantable transducer may be provided so that, in a deflected state, the contact tip may apply a lateral loading force that is maintained at a magnitude that is greater than the magnitude of axial load force applied by the contact tip upon initial placement as well as during axial displacement in response to operation of an implantable transducer to yield auditory component stimulation. Even more particularly, the vibratory actuator and transducer may be provided to yield a lateral loading force on an auditory component by the contact tip that is at least two times greater than the axial load force applied thereto by the contact tip.

In one approach, a deflectable portion of the vibratory actuator may be of a compliant nature so as to flex (e.g., elastically deform) and thereby accommodate lateral displacement of a contact tip and otherwise yield a desired lateral loading force at the contact tip. In another approach, a distal end of a vibratory actuator may be pivotable relative to a proximal end of the vibratory actuator so as to accommodate lateral displacement of the contact tip, wherein an external force means (e.g., a magnetic field defined at an implantable transducer) to act upon the proximal end to yield a lateral loading force at the contact tip. As may be appreciated, the noted approaches may be implemented separately or together.

In yet another aspect, a contact tip may comprise a convex surface portion for directly contacting a lateral aspect of the auditory component. The provision of the convex surface portion facilitates relative contact movement between the contact tip and an auditory component. In one arrangement, the contact tip may be of a rounded configuration (e.g. a ball-end configuration.)

An inventive method is also provided for use in connection with the mechanical stimulation of an auditory component by an implantable hearing aid transducer. The method includes the step of contacting a contact tip with a lateral aspect of an auditory component, wherein the contact tip is interconnected to a distal end of a vibratory actuator that is axially displaceable in response to operation of an interconnected implantable hearing aid transducer. The method further includes the steps of moving the contact tip relative to the auditory component while maintaining the contact therewith, and displacing the contact tip to an initial loaded position in response to the moving step, wherein the contact tip applies an initial lateral loading force to the lateral aspect of the auditory component.

The method may further include the step of automatically displacing the contact tip to another loaded position, after the moving step, in response to post-implantation auditory component, wherein the contact tip remains in contact with and applies another lateral loading force to the lateral aspect of the auditory component. In this regard, the initial loaded position and the another loaded position may each be within a predetermined displacement range for the contact tip that is provided by the vibratory actuator and/or the transducer. Further, the initial loading force and the another loading force may each be within a predetermined force range that is provided on the vibratory actuator and/or the transducer. By way of example, a predetermined displacement range provided that is about 0.1 millimeters to 1 millimeters, and a corresponding predetermined force range may be provided that is about 0.056 gf to 2.08 gf.

In conjunction with the inventive method, the displacing step may include a step of deflecting at least a portion of the vibratory actuator. In turn, the deflecting step may entail flexing said portion of the vibratory actuator and/or pivoting a distal end of the vibratory actuator relative to a proximal end thereof.

In yet another aspect, the contacting step and/or moving step may entail linearly advancing the contact tip relative to the auditory component. Alternatively or additionally the contacting step and/or moving step may include advancing the contact tip along an arcuate path relative to an auditory component.

In yet a further aspect, the inventive method may include a step of operating the implantable transducer to successively advance and retract the vibratory actuator and contact tip relative to an auditory component, wherein an axial force is applied to the auditory component. In turn, the method may provide for maintaining the lateral loading force applied by the contact tip to the auditory component at a magnitude greater than the axial force applied by the contact tip during operation of the transducer. In this regard, it may be preferable to maintain the lateral loading force at least two times greater than the axial force.

Additional aspects and advantages relating to the present invention may be apparent to those skilled in the art upon consideration of the further description that follow.

DETAILED DESCRIPTION

Figure 1:
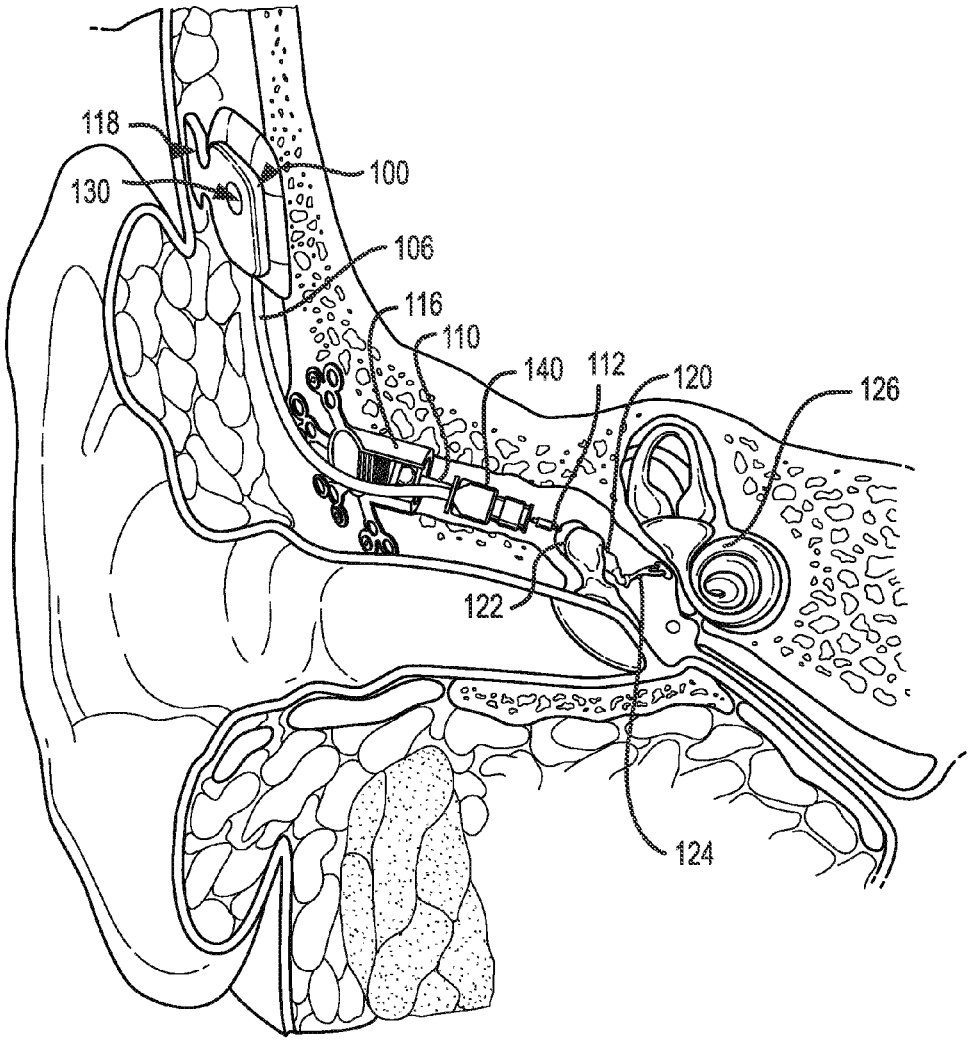
FIG. 1 illustrates a fully implantable hearing instrument as implanted in a wearer's skull.

FIG. 1 illustrates one application of the present invention. As illustrated, the application comprises a fully implantable hearing instrument system. As will be appreciated, aspects of the present invention may be employed in conjunction with semi-implantable hearing instruments as well.

In the illustrated system, a biocompatible implant housing 100 is located subcutaneously on a patient's skull. The implant housing 100 includes a signal receiver 118 (e.g., comprising a coil element) and a microphone 130 that is positioned to receive acoustic signals through overlying tissue. The signal receiver 118 may be utilized for transcutaneously re-charging an energy storage device within the implant housing 100 as well as for receiving program instructions for the hearing instrument system.

The implant housing 100 may be utilized to house a number of components of the fully implantable hearing instrument. For instance, the implant housing 100 may house an energy storage device, a microphone transducer, and a signal processor. Various additional processing logic and/or circuitry components may also be included in the implant housing 100 as a matter of design choice. Typically, the signal processor within the implant housing 100 is electrically interconnected via wire 106 to an electromechanical transducer 140.

The transducer 140 is supportably connected to a positioning system 110, which in turn, is connected to a bone anchor 116 mounted within the patient's mastoid process (e.g., via a hole drilled through the skull). The transducer 140 includes a vibratory actuator 112 for operatively interfacing the transducer 140 to the ossicles 120 of the patient. In an operative state, the vibratory actuator 112 provides a communication path for acoustic stimulation of the ossicles 120, e.g., through transmission of vibrations to the incus 122. As will be more fully discussed herein, the vibratory actuator may form a lateral contact interface between the transducer 140 and the ossicles.

During normal operation, acoustic signals are received subcutaneously at the microphone 130. Upon receipt of the acoustic signals, a signal processor within the implant housing 100 processes the signals to provide a processed audio drive signal (e.g., a transducer drive signal) via wire 106 to the transducer 140. As will be appreciated, the signal processor may utilize digital processing techniques to provide frequency shaping, amplification, compression, and other signal conditioning, including conditioning based on patient-specific fitting parameters. The audio drive signal causes the transducer 140 to transmit vibrations at acoustic frequencies to the vibratory actuator 112 to effect the desired sound sensation via mechanical stimulation of the incus 122 of the patient. These vibrations are then transmitted from the incus 122 to the stapes 124, effecting a stimulation of the cochlea 126.

Figure 2A:
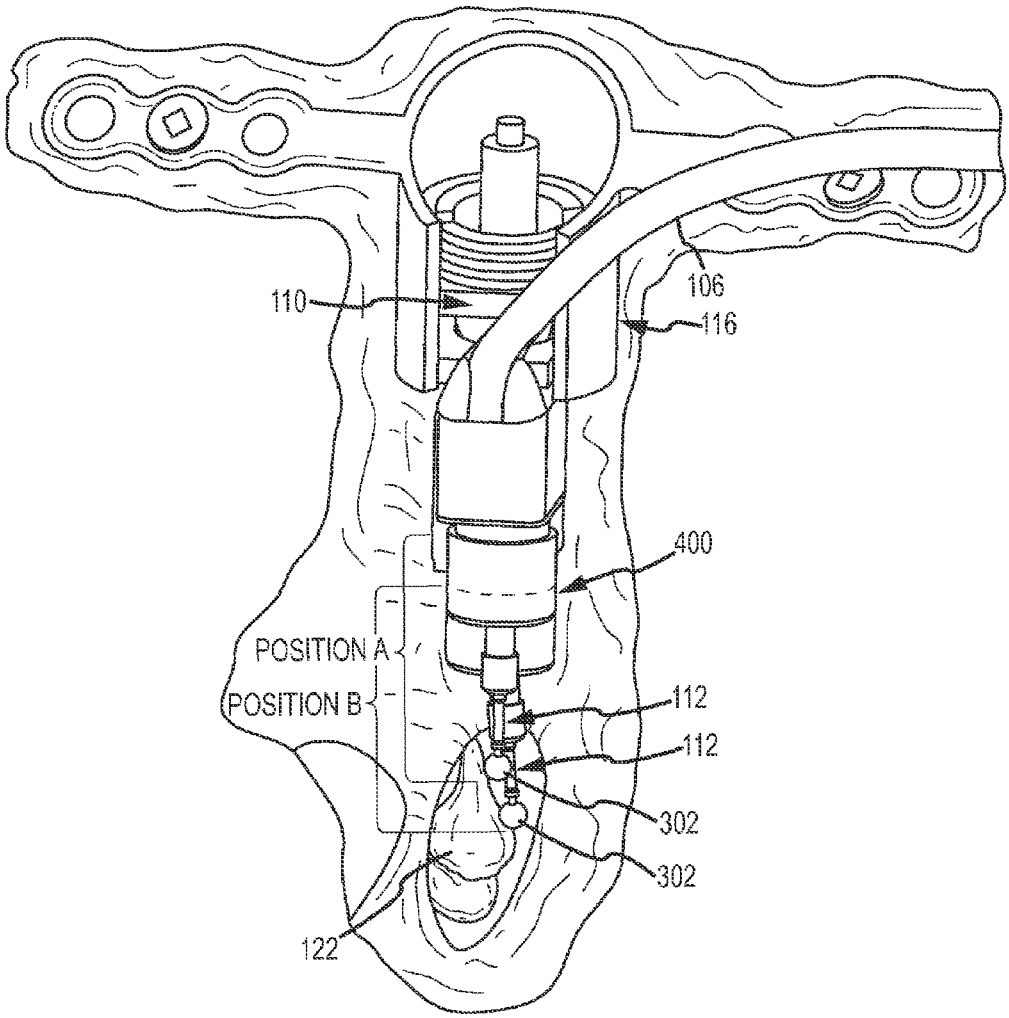
FIG. 2A illustrates one embodiment of the present invention in operative contact with an auditory component.
Figure 2B:
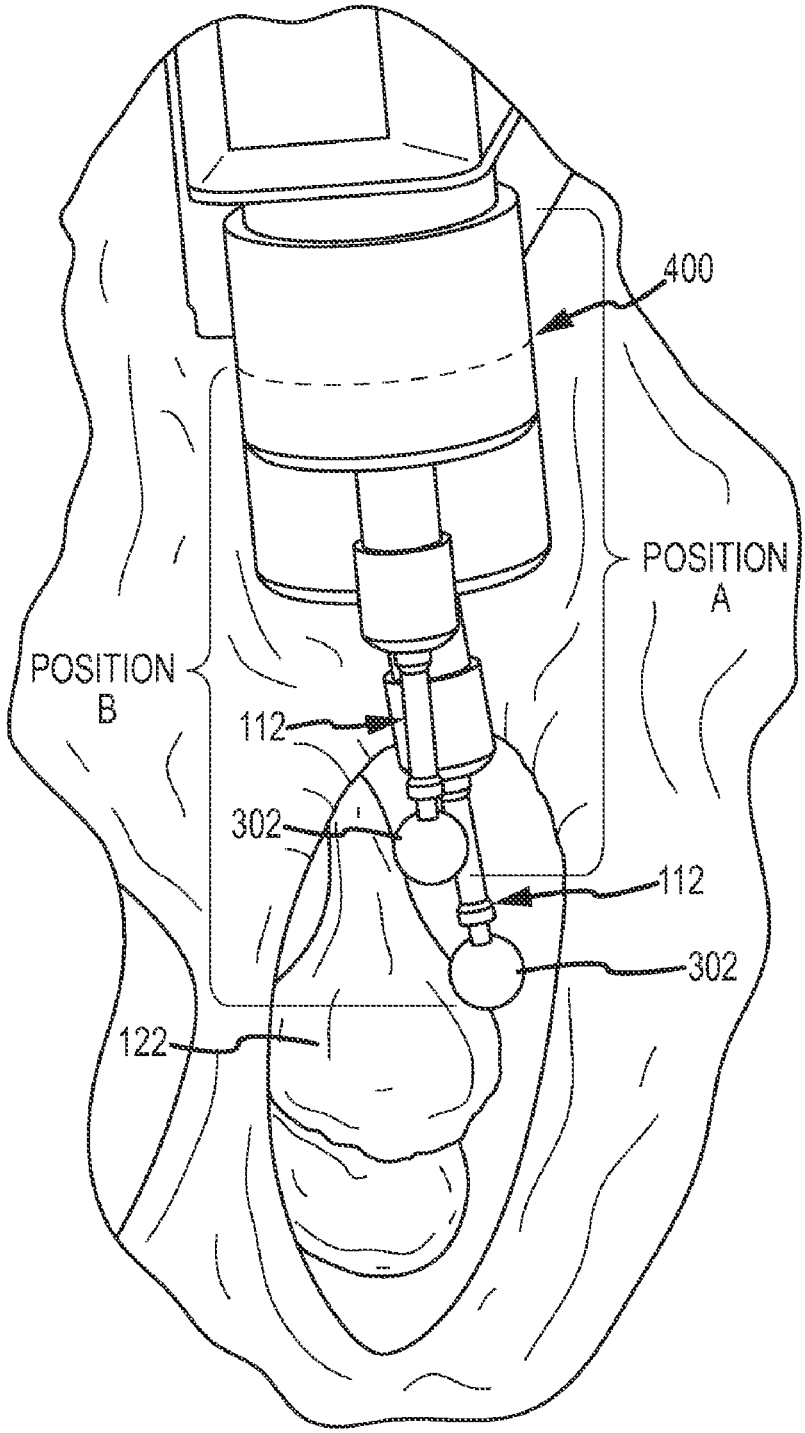
FIG. 2B illustrates an enlarged portion of the Fig. A.

FIGS. 2A and 2B each illustrate a contact tip 302 interconnected to the transducer 140 via the vibratory actuator 112, as disposed (e.g., by the positioning system 110 and bone anchor 116) proximate to a lateral aspect of the incus 122, in both an initial contact position A and in a superimposed, advanced position B. In this regard, and as previously noted, it has been determined that adequate transfer of mechanical energy (e.g., vibrations) from the transducer 140 to the incus 122 may be achieved by a lateral contact loading of the contact tip 302 of the transducer 140 to the incus 122, or other ossicle bone as the case may be. For such purposes, at least a portion of the vibratory actuator 112 may be laterally deflectable. In turn, during implant procedures the transducer 140 may be advanced so that the contact tip 302 contacts the incus 122 (e.g., position A in FIGS. 2A and 2B), and then the transducer 140 may be further advanced so that the contact tip 302 may be laterally displaced and the vibratory actuator 112 may be correspondingly deflected (e.g., position B in FIGS. 2A and 2B), wherein a predetermined force is applied to the lateral aspect of the incus 122.

In this regard, it should be noted that ligaments (not shown) are connected to the ossicular chain. These ligaments counteract the lateral loading force applied by the contact tip 302. Stated otherwise, the ligaments pull the incus towards its unloaded or static location and thereby against the contact tip 302.

Of further note, when the transducer 140 is operated during use to displace the transducer tip 302 (e.g., axially), the transducer tip 302 may be axially advanced relative to the incus 122. Accordingly, the incus 122 may be displaced (i.e., to the right as shown in FIG. 2). In contrast, when the transducer tip 302 is retracted relative to the incus 122, the ligaments interconnected to the incus 122 may pull the incus back towards its static location as the transducer tip 302 retracts (i.e., to the right in FIG. 2). By virtue of the initial loading of the incus 122, the incus 122 may be operative to move in contact with the contact tip 302 for both positive and negative transducer tip displacements.

As may be appreciated from the foregoing description, it has been determined that it is not necessary to physically attach the contact tip 302 to the ossicle bone utilizing, for example, a hole drilled into the bone or by using a clip or clamp arrangement that extends around the ossicle bone to mount the transducer tip to the bone. That is, the lateral "force loading" of the ossicle bone provides the necessary contact for sustained stimulation purposes.

As previously noted, an auditory component, such as the incus 122, may move laterally after an implant procedure (e.g., after initial placement of contact tip 302.) Such movement may be the result of pressure changes (e.g., changes in altitude) affecting the ossicular chain and/or physical movements of the patient (e.g., yawning). In such instances of post-implantation auditory movement, it has been determined that the maintenance of a contact relationship may be facilitated by use of a vibratory actuator 112 having a deflectable portion that works to allow the contact tip 302 to laterally deflect across a continuum of positions within a predetermined range. In turn, the contact tip 302 may maintain contact with an auditory component upon initial placement, as well as during and subsequent to post-implantation auditory component movement.

More particularly, a deflectable portion of the vibratory actuator 112 may be provided so that the contact tip 302 may be displaced in either a first direction or a second direction to an initial loaded position within a predetermined range upon initial placement, and so that the contact tip 302 may automatically move to one or more other loaded position(s) within the predetermined range after initial placement (e.g. upon further deflection or reduced deflection of vibratory actuator 112.) In this regard, the predetermined range may be established so that the resultant contact yields a lateral loading force on an auditory component within a desired force range at all positions across the predetermined range.

Reference is now made to FIGS. 3A, 3B, 4A and 4B which illustrate an embodiment of implantable transducer 400 physically interconnected to a positioning system 110 and electrically interconnected to a wire 106 (e.g., for interconnection with an implant housing 100.) The positioning system 110 may be selectively, physically interconnected to a bone anchor 116, of the type shown in FIG. 1.

The bone anchor 116 may be of a type as taught in U.S. Pat. No. 6,293,903 entitled "APPARATUS AND METHOD FOR MOUNTING IMPLANTABLE HEARING AID DEVICE", issued Sep. 25, 2001, the entirety of which is hereby incorporated by reference. Further, the positioning system 110 may be of the type as generally taught by U.S. Pat. No. 6,491,622 entitled "APPARATUS AND METHOD FOR POSITIONING AN IMPLANTABLE HEARING AID DEVICE" issued Dec. 10, 2002, the entirety of which is hereby incorporated by reference.

In short, the positioning system 110 may include a carrier assembly 20 and a swivel assembly 40 that allow for selective three-dimensional positioning of the transducer 400 and interconnected contact tip 402 at a desired location within a patient. In this regard, the transducer 400 may be supportively connected to a first end 22 of the carrier assembly 20. In turn, the carrier assembly 20 may be supportively received and selectively secured in an opening defined through a ball member 42 that is captured between plates 44 of the swivel assembly 40. The interface between the carrier assembly 20 and swivel assembly 40 provides for pivotable, lateral positioning of the first end 22 of the carrier assembly 20 and of the transducer 400 interconnected thereto. That is, the carrier assembly 20 may pivot upon rotation of the ball member 42, thereby allowing the contact tip 402 to be moved along an arcuate path to a desired position. In turn, the interconnected plates 44 may be selectively secured to a bone anchor 116 maintain a select pivotal orientation. Further, the carrier assembly 20 may be selectively secured along a continuum positions within the opening of the swivel assembly 40, thereby facilitating linear advancement/retraction of the carrier assembly 20 and interconnected transducer 400 and contact tip 402 in a depth dimension. Additionally, the carrier assembly 20 may be defined so that its first end 22 may be selectively advanced and retracted in the depth of dimension relative to an outer support member 24 thereof (e.g., by utilizing a lead screw arrangement), thereby further facilitating selective linear positioning of the transducer 400 and contact tip 402.

As may be appreciated, in relation to an implementation as shown in FIGS. 2A and 2B, the positioning system 110 may be employed to move (e.g., advance or retract) the contact tip 402 toward an auditory component by moving the carrier assembly 20 relative to the swivel assembly 40, by moving the first end 22 of the carrier assembly 20 relative to the support member 24 thereof and/or by pivoting the carrier assembly 20 relative to the plates 44 of the swivel assembly 40.

Figure 3A:
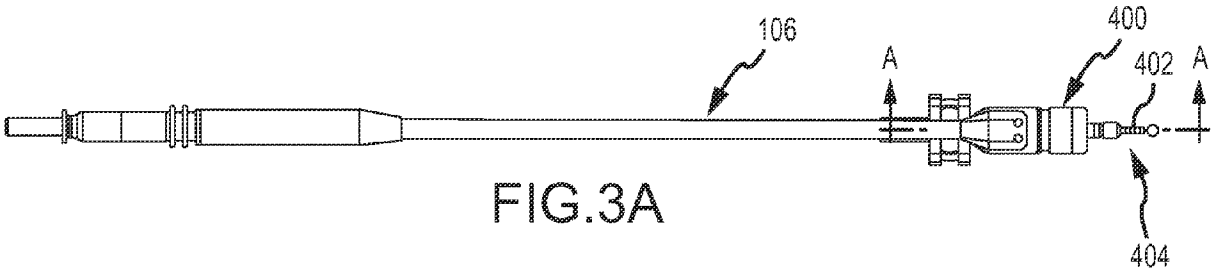
FIG. 3A illustrates a top view of another embodiment of the present invention.
Figure 3B:
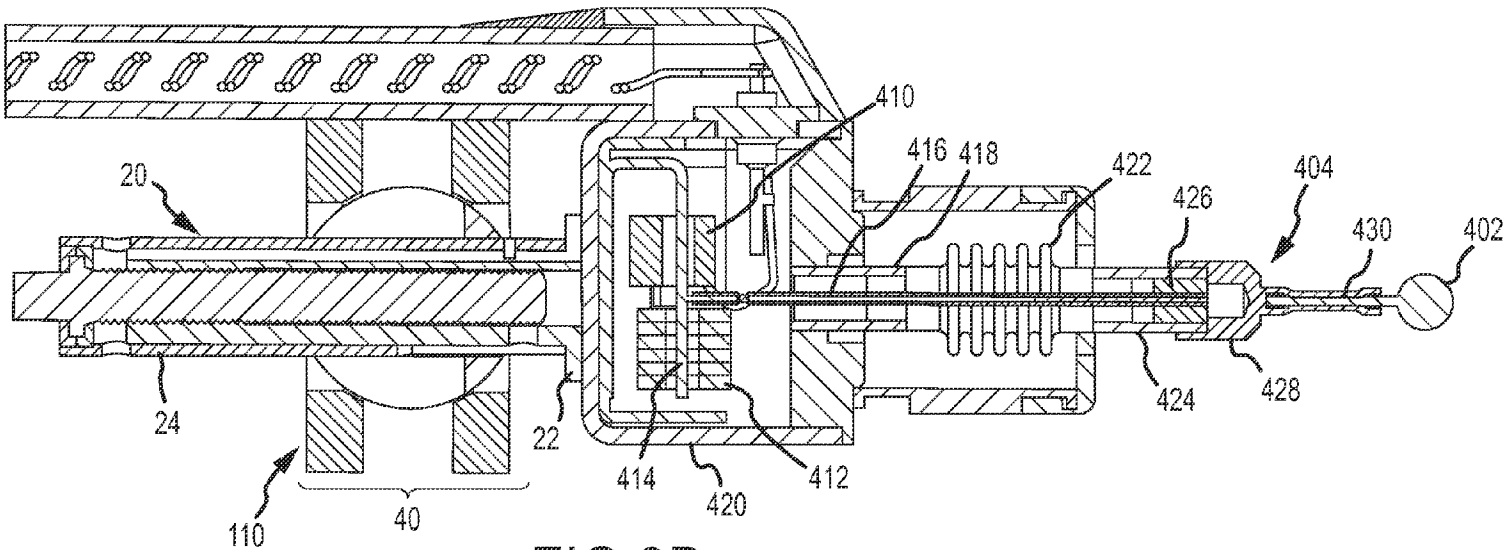
FIG. 3B illustrates a side cross-sectional view of the embodiment shown in FIG. 3A, as taken along the section cut line AA shown in FIG. 3A.
Figure 4A:
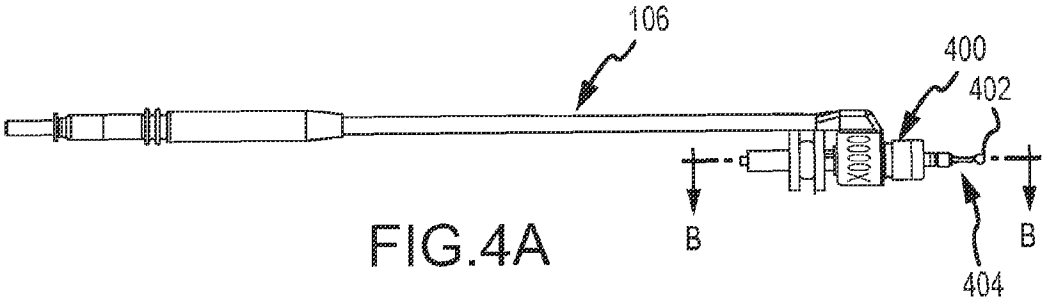
FIG. 4A illustrates a side view of the embodiment of FIG. 3A.
Figure 4B:
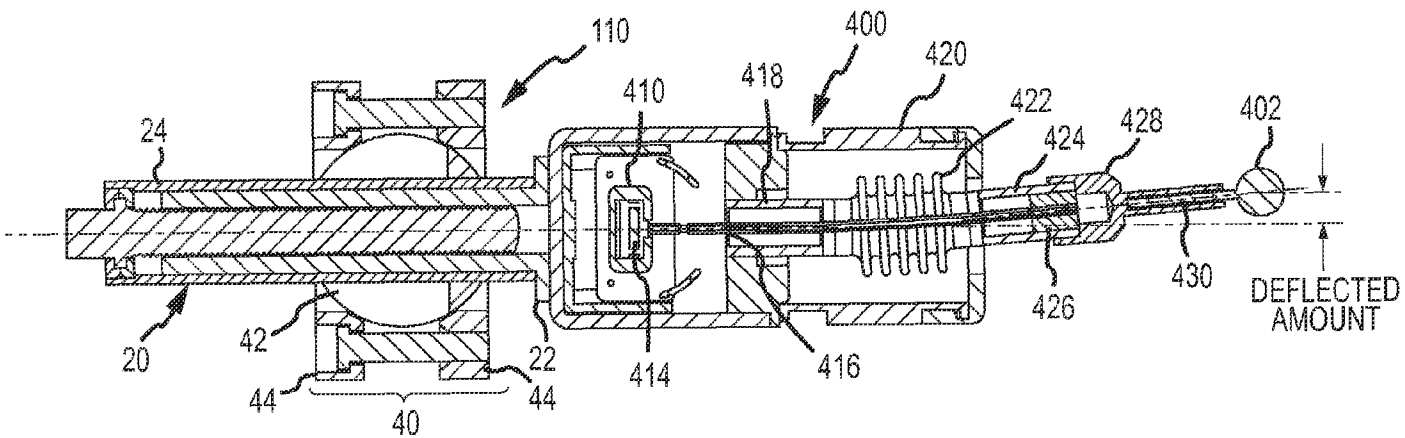
FIG. 4B illustrates a top cross-sectional view of the embodiment of FIG. 3A, as taken along the section cut line BB shown in FIG. 4A, wherein a vibratory actuator is in a deflected state.

As shown, the contact tip 402 of transducer 40, may be interconnected to a distal end of the axially displaceable vibratory actuator 404, wherein axial displacement of the vibratory actuator 404 may be utilized to effect contact stimulation of an auditory component. In additional to being axially displaceable, the vibratory actuator 404 may be further provided to allow for lateral deflection or displacement of the contact tip 402. That is, as illustrated in FIG. 3B, at least a portion the vibratory actuator may be laterally deflectable so that the contact tip 402 may be displaced in either a first direction within a predetermined range and/or in a second direction within a predetermined range relative to a center axis of contact between the contact tip 402 and an auditory component. For example, the contact center axis coincidental within center axis of the vibratory actuator 404.

In the embodiment illustrated in FIGS. 3A, 3B, 4A and 4B the transducer 400 may comprise a transducer housing 420 that houses a magnetic coil 410, and stacked magnetic members 412, each of which extend about a leaf member 414, wherein the magnetic coil 410 and magnetic members 412 may be electrically driven to a generate a magnetic field to induce vibratory movement of the leaf member 414 at desired acoustic frequencies. The leaf member 414 may be interconnected to a drive pin 416 as shown.

Further in this regard, the drive pin 416 may be disposed to pass through a first plug member 418 that is proximally interconnected to the transducer housing 420 (e.g., via laser welding to yield a hermetic seal), a bellows member 422 that is proximally interconnected to a distal end of the first plug member 418 (e.g., via laser welding to yield a hermetic seal), and a second plug member 424 that is proximally interconnected to a distal end of the bellows member 422 (e.g., via laser welding to yield a hermetic seal.) The second plug member 424 may be distally interconnected to a distal end of the drive pin 416 via an intermediate plug member 426 (e.g., via laser welding to yield a hermetic seal), wherein the second plug member 424 may be axially displaceable with the drive pin 416. In this regard the bellows member 422 may be provided with undulations that facilitate movement of drive pin 416 and the second plug member 424 relative to the transducer housing 420, while allowing the first plug member 418 to maintain a fixed position relative to the transducer housing 420. Further, the undulations of the bellows member 422 accommodate flexure of the drive pin 116 in connection with deflected displacement of the contact tip 402 during use, as shown in FIG. 3B.

As further illustrated, an adapter member 428 may be interconnected to a distal end of the second plug member 424 and may include a slotted portion for receiving an elongate member 430 interconnected to the contact tip 402 (e.g. integrally formed therewith.) More particularly, the elongate member 430 may be inserted into the slotted portion of the adapter member 428, wherein an outside surface of the slotted portion of the adapter member 428 may be crimped to maintain the contact tip 402 at desired fixed position relative to the adapter member 428.

Figure 5A:
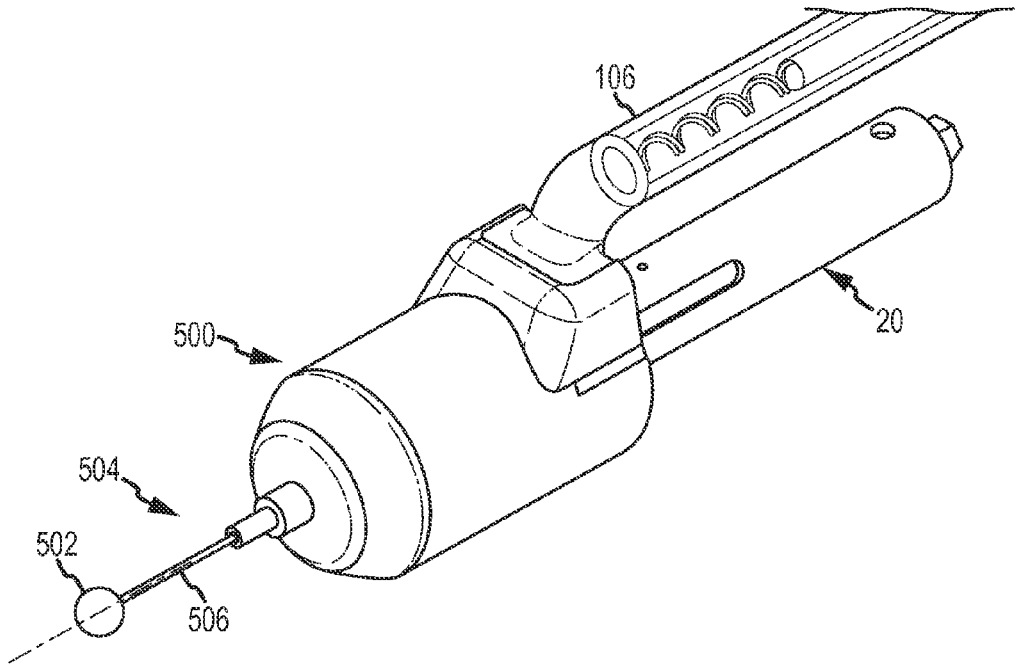
FIG. 5A illustrates a perspective view of another embodiment of the present invention, wherein a vibratory actuator tip is in an undeflected state.
Figure 5B:
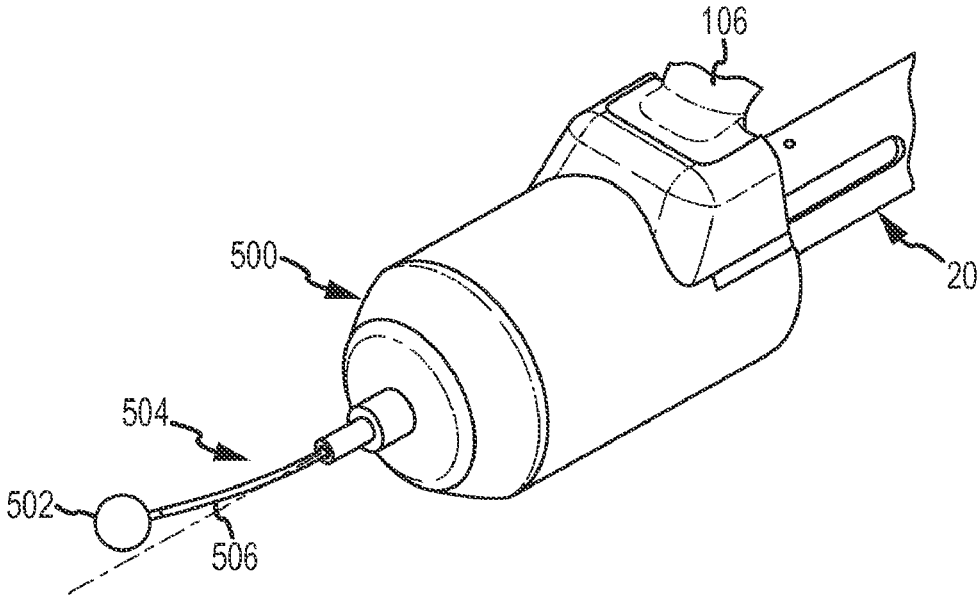
FIG. 5B illustrates a perspective view of the embodiment shown in FIG. 5A, wherein the vibratory actuator is in a deflected state.
Figure 6A:
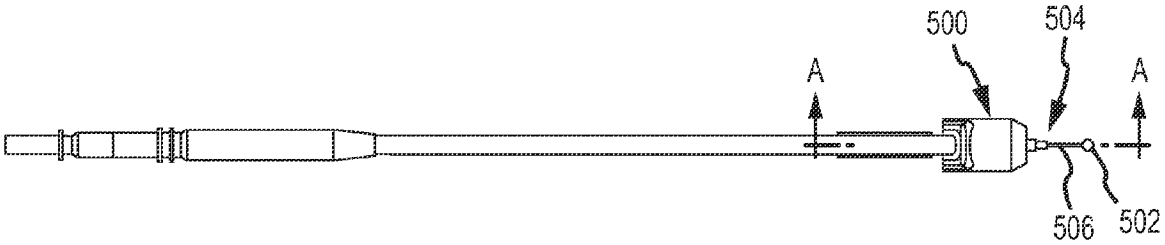
FIG. 6A illustrates a top view of the embodiment shown in FIG. 5A.
Figure 6B:
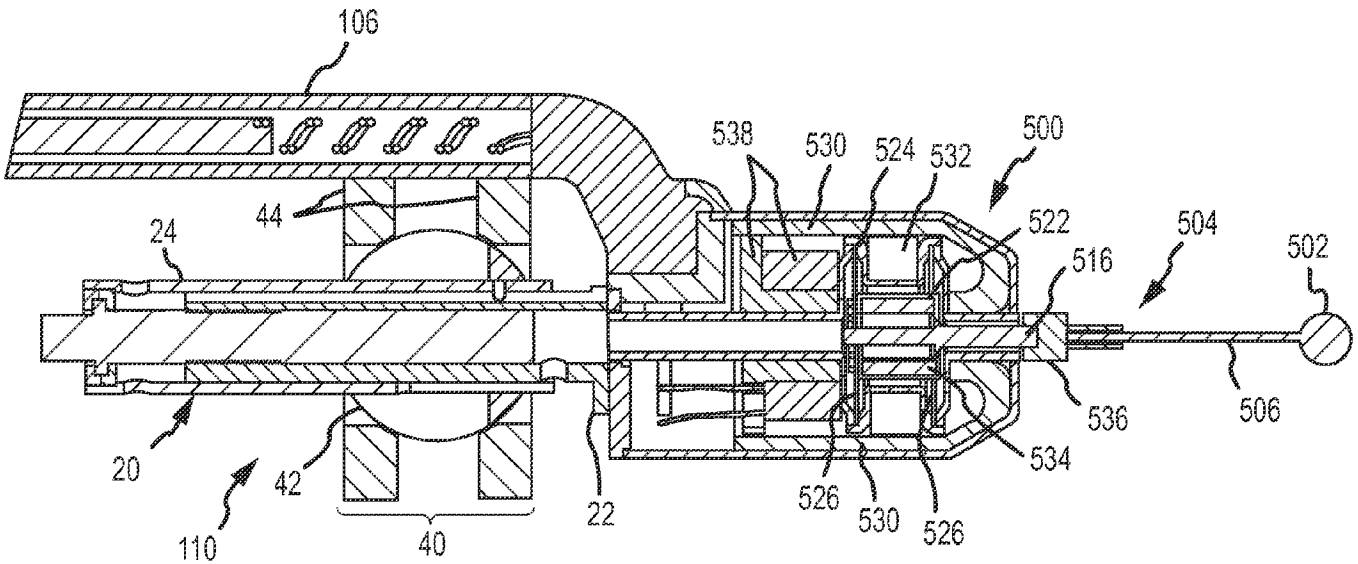
FIG. 6B illustrates a side cross-sectional view of the embodiment of FIG. 5A, as taken along the section cut line AA shown in FIG. 6A.

Referring now to FIGS. 5A, 5B and 6, another embodiment of a transducer 500 with a laterally displaceable tip member 502 is illustrated. In the position shown in FIG. 5A, the contact tip 502 is disposed co-axially with a vibratory actuator 504. FIG. 5B illustrates the contact tip 502 in a displaced position and the vibratory actuator 504 in a deflected state. As may be appreciated, such a deflected state may be realized when the contact tip 502 is advanced after initial contact with a lateral aspect of an auditory component (e.g. in a manner analogous to that shown in relation to the contact tip 402 in FIG. 4.) In this embodiment, the deflection of tip member 502 may be provided by virtue of a compliant, elongate member 506 interconnected to the contact tip 502 (e.g. integrally formed therewith.)

With particular reference to FIG. 6, the transducer 500 includes a transducer housing 520 physically interconnected to a positioning system 110. In turn, the positioning system 110 may be interconnected to a bone anchor 116, in a manner analogous to the arrangement shown in FIG. 1.

In this embodiment, the transducer housing 520 houses a variable reluctance motor arrangement. The principles of operation of such an arrangement is taught by U.S. Pat. No. 7,166,069 entitled VARIABLE RELUCTANCE MOTOR, issued Jan. 23, 2007, the entirety of which is hereby incorporated by reference.

The transducer 500 includes a drive pin 516 that is interconnected to a sealed canister 522 which houses an armature member 534. The canister 522 and interconnected drive pin 516 are moveably positioned within an H-shaped magnetic housing 524 that is fixedly interconnected to the transducer housing 520. Wafer spring members 526 may be provided at each end of the canister 522, wherein the wafer spring members 526 are interconnected to the canister 522 at an inner periphery thereof, and wherein an outer periphery of the wafer spring members 526 may be interconnected to the housing 524. Such an arrangement provides for centered support of the canister 522 within housing 524, yet allows for relative axial movement between the canister 522/drive pin 516 and the housing 524.

As further illustrated, a back iron member 530 may be positioned about the magnetic housing 524. In turn, a fixed, ring-shaped magnet 532 (e.g., a permanent magnet) may be located within the back iron member 530 and about the housing 524 and canister 522 disposed therewith.

Further, a ring-shaped magnetic coil assembly 538 may be disposed within the back iron member 530 adjacent to a proximal end of the housing 524. As may be appreciated, the magnetic coil assembly 538 permanent magnet 532 and back iron member 530 may collectively define a stator member.

The drive pin 516 may be interconnected to an adapter member 536 having distal slotted portion for slideably receiving the elongate member 506. The slotted portion of adapter member 536 may be secured to the elongate member 506, (e.g., via crimping, welding, etc.) In operation, armature member 534 may be linearly displaced by varying the magnitude of a current applied to the magnetic coil assembly 538. In turn, the canister 522 and drive pin 516 may be linearly advanced/retracted at acoustic frequencies to stimulate an auditory component via vibratory actuator 504 and contact tip 502.

The above-noted embodiments are provided for purposes of illustration. Numerous modifications, adaptations and extensions are contemplated and are intended to be within the scope of the present invention.

What is claimed:

1. An apparatus employable with an implantable hearing aid transducer for mechanically stimulating an auditory component, comprising:

a contact tip having a convex surface portion adapted for directly contacting a lateral aspect of an auditory component without being physically attached thereto; and a vibratory actuator that displaces axially in response to operation of an interconnected implantable hearing aid transducer, said contact tip being interconnected to a distal end of the vibratory actuator for axial displacement therewith, wherein at least a portion of the vibratory actuator is configured for lateral deflection in a direction transverse to the long axis of the vibratory actuator, and wherein said contact tip is laterally displaced upon lateral deflection of the vibratory actuator to maintain contact with and apply a lateral loading force to an auditory component.

2. An apparatus as recited in claim 1, wherein said vibratory actuator is laterally deflectable to laterally displace said contact tip in a first direction within a predetermined displacement range, and wherein said predetermined displacement range is greater than a predetermined maximum value for post-implantation auditory component movement.

3. An apparatus as recited in claim 2, wherein said vibratory actuator is provided so that said contact tip applies a predetermined lateral loading force within a predetermined force range when the contact tip is displaced at any position across said predetermined displacement range.

4. An apparatus as recited in claim 3, wherein said predetermined displacement range is 0.1 millimeter to 1 millimeter, and wherein said predetermined force range is 0.056 gf to 2.08 gf.

5. An apparatus as recited in claim 3, wherein said vibratory actuator is laterally deflectable to laterally displace said contact tip in a second direction within said predetermined displacement range, wherein said direction is opposite to said first direction.

6. An apparatus as recited in claim 1, wherein said distal end of said vibratory actuator is pivotable relative to a proximal end of said vibratory actuator to affect lateral displacement of said contact tip.

7. An apparatus as recited in claim 1, wherein said portion of the vibratory actuator is compliant to affect lateral displacement of said contact tip.

8. An apparatus as recited in claim 1, wherein said contact tip is of a rounded configuration.

9. A method for mechanically stimulating an auditory component with an implantable hearing aid transducer, comprising:

contacting a contact tip, interconnected to a distal end of a vibratory actuator that is axially displaceable in response to an interconnected implantable hearing aid transducer, with a lateral aspect of an auditory component without being physically attached thereto;

moving said contact tip relative to said auditory component while maintaining contact therewith; and displacing said contact tip to an initial position in response to said moving step by deflecting at least a portion of the vibratory actuator in a direction transverse to the long axis of the vibratory actuator, wherein said contact tip applies an initial lateral loading force to a lateral aspect of said auditory component.

10. A method as recited in claim 9, further comprising:

automatically displacing said contact tip, after said moving step, in response to movement of said auditory component, wherein said contact tip remains in contact with and applies another lateral loading force to a lateral aspect of said auditory component.

11. A method as recited in claim 10, wherein said initial position in said another position a reach within a predetermined displacement range, and said range initial loading force in said another loading force a reach within a predetermined force range.

12. A method as recited in claim 11, wherein said predetermined displacement range is 0.1 millimeter to 1 millimeter, and wherein said predetermined force range 0.056 gf to 2.08 gf.

13. A method as recited in claim 9, wherein said deflecting step comprises:

flexing at least a part of said portion of the vibratory actuator.

14. A method as recited in claim 9, wherein said deflecting step includes:

pivoting a distal end of the vibratory actuator relative to a proximal thereof.

* * * * *